United States Patent [19]

Wischusen, III

[11] Patent Number: 4,779,998

[45] Date of Patent: Oct. 25, 1988

[54] COMPOSITE BAG-LIKE PACKAGE

[75] Inventor: Henry Wischusen, III, Lilburn, Ga.

[73] Assignee: Rock-Tenn Company, Norcross, Ga.

[21] Appl. No.: 912,960

[22] Filed: Sep. 26, 1986

[51] Int. Cl.[4] ..... B65D 30/10

[52] U.S. Cl. ..... 383/121; 383/7; 383/104; 383/71

[58] Field of Search ..... 383/121, 7, 10, 71, 383/104; 206/217; 150/50

[56] References Cited

U.S. PATENT DOCUMENTS

| | | | |
|---|---|---|---|
| 948,524 | 2/1910 | Reid | 229/904 |
| 2,011,179 | 8/1935 | Krout | 383/117 |
| 2,556,321 | 6/1951 | Denton | 229/87 R |
| 3,061,170 | 10/1962 | Baker | 383/121 |
| 3,129,848 | 4/1964 | Canno | 383/121 |
| 3,285,495 | 11/1966 | Colato | 206/217 |
| 3,317,117 | 5/1967 | Goodwin | 383/121 |
| 3,660,959 | 5/1972 | La Fleur | 383/7 |

*Primary Examiner*—Willis Little

*Attorney, Agent, or Firm*—Jones, Askew & Lunsford

[57] ABSTRACT

A package of the type used to contain one or more products to be carried out of a store or restaurant, includes a paperboard base tray having tapered side walls and a tapered, flexible bag portion made, for example, of transparent plastic film. The sleeve forming the bag portion is attached to the side walls of the base. The package thus has a rigid, smooth inner bottom for supporting upstanding articles, such as drink cups, has the capability of being nested in an open configuration for storage, and can be made from a minimum of materials.

13 Claims, 3 Drawing Sheets

COMPOSITE BAG-LIKE PACKAGE

TECHNICAL FIELD

The present invention relates to packages of the type used to contain one or more products to be carried out of a store or restaurant, and more particularly relates to a composite package having a paperboard base and flexible sheet side walls made, for example, of transparent plastic film.

BACKGROUND ART

Since the beginning of commerce, vendors have devised ways of containing and protecting their wares for transportation by the purchaser following a sale. The vendor normally desires that the packaging be inexpensive and disposable. Various wrappings such as paper or newsprint have generally given way to the ubiquitous brown paper bag, now often provided in many colors with some type of handle, and often decorated with the vendor's trademarks and advertising. More recently, many stores selling hard goods have provided plastic shopping bags to consolidate purchases.

Designing take-out containers for the restaurant industry has presented special problems, because many of the individual produict containers must be supported in an upright orientation during transportation. For example, drink cups are subject to spilling their contents, as are open-top french fry bags and boxes. While a flat-bottomed paper bag may provide some support, cups are very subject to tilting and leaking, and a few french fries invariably find their way to the bottom of the paper bag, even from flat-bottomed french fry boxes. Plastic shopping bags provide no means for keeping such containers upright.

U.S. Pat. No. 948,524 shows an attempt to provide stability for ice cream cones by providing a cardboard cone holder that is inserted into a paper bag. This device has the disadvantage of requiring two separate packaging products, the holder and the bag, and the resulting expense of manufacture and extra handling required to fit the products together.

U.S. Pat. No. 2,011,179 shows a candy container according to which a tube of cellulose sheeting reinforced by a tube of mesh is wrapped around a flat, rigid base and tucked into a central opening in the base. The base can also include an outer tray into which the inner base fits, trapping the bag material. The bunched material passing up through the inner base would interrupt the smooth inner surface of the base and make it difficult to place items such as drink cups. Furthermore, the construction shown requires many parts and the container apparently would not be nestable to reduce storage space prior to use.

U.S. Pat. No. 2,556,321 shows a liner for a box, the liner being a conventional bag having a collar attached to its exterior to facilitate opening of the bag and insertion into the bottom portion of the box. The operation of the collar would make it impossible to taper the walls of the bag to allow nesting of bags when opened. Also, the device of this patent does not provide a bag having a rigid bottom. In the configuration providing a rigid bottom, that is, with the liner inserted into the box bottom, the container is not intended to be lifted by holding the top portion of the liner, because the box would fall off the liner.

Thus, there has been a need for a flexible bag that has a rigid, smooth inner bottom for receiving upstanding articles, has the capability of being nested in an open configuration for storage, and can be made from a minimum of materials.

SUMMARY OF THE INVENTION

The present invention solves this and other needs in the art by providing a package for carrying articles, constructed with a flexible sleeve engaging the exterior side wall of a relatively rigid base tray.

Generally described, the present invention provides a package for carrying articles, comprising a base tray including a bottom panel and a side wall extending upwardly from the bottom panel, and a flexible sleeve having a bottom opening defined by a continuous bottom edge, the bottom edge of the sleeve lying along and being attached to the exterior surface of the side wall of the base tray.

More particularly described, the present invention provides a package for carrying articles, comprising a base tray including a bottom panel defining a peripheral edge and and a side wall extending upwardly from the peripheral edge of the bottom panel at an angle greater than 90 degrees from the bottom panel, the side wall defining an upper peripheral edge longer than the peripheral edge of the bottom panel; and a flexible sleeve having a bottom opening defined by a continuous bottom edge, the bottom edge of the sleeve having a length approximately equal to or greater than the length of the peripheral edge of the bottom panel of the base tray but shorter than the upper peripheral edge of the side wall; the sleeve being positioned about the exterior of the base tray such that the bottom edge of the sleeve engages the side wall. Preferably, the invention includes adhesive connecting the sleeve to the exterior of the side wall of the base tray.

The sleeve preferably tapers outwardly from the bottom edge up, at an angle sufficient to allow nesting of the containers for storage. The tapering angle of the sleeve is preferably, though not necessarily, equal to or less than the tapering angle of the side wall. The top portion of the sleeve can be slit or otherwise provided with handle means defined adjacent to the top opening of the sleeve.

The side wall of the base tray preferably includes a plurality of flat side panels connected to one another and extending from the bottom panel. The sleeve can have one of several configurations, including: a plurality of flexible panels each extending upwardly from one of the side panels, and joined to one another along seams extending upwardly from the connections between the side panels; a single sheet of flexible material wrapped around the base tray and joined along a single seam; two sheets of flexible material wrapped around opposite halves of the base tray and joined along a pair of seams; or an extruded seamless tube into which the baes tray is inserted. Furthermore, the invention can be embodied in non-rectangular containers. For example, the side wall of the base tray may comprise a frusto-conical member extending from the bottom panel, and the sleeve comprises an extruded seamless frusto-conical member.

Thus, is an object of the present invention to provide an improved package for carrying items.

It is a further object of the present invention to provide a bag-like carry out package capable of supporting items in an upright position.

It is a further object of the present invention to provide a lightweight carry out bag having a rigid bottom.

It is a further object of the present invention to provide a carry out package made from a minimum of materials.

It is a further object of the present invention to provide a carry out package capable of displaying its contents.

Other objects, features, and advantages of the present invention will become apparent upon reading the following detailed description of embodiments of the invention, when taken in conjunction with the accompanying drawing and the appended claims.

DETAILED DESCRIPTION

Figure 1:
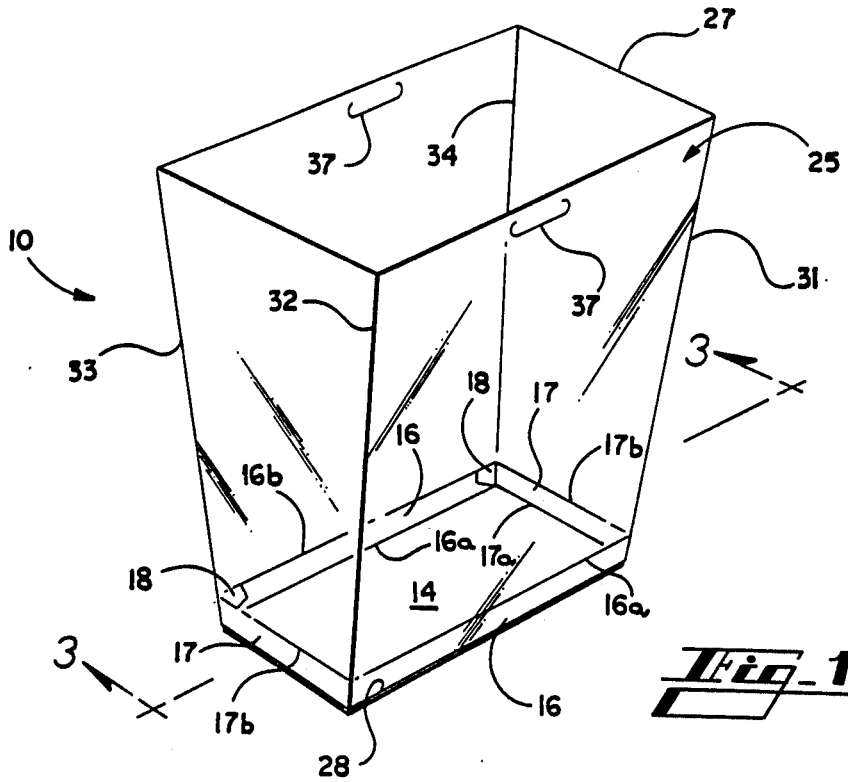
FIG. 1 is a perspective view of a package embodying the present invention.
Figure 2:
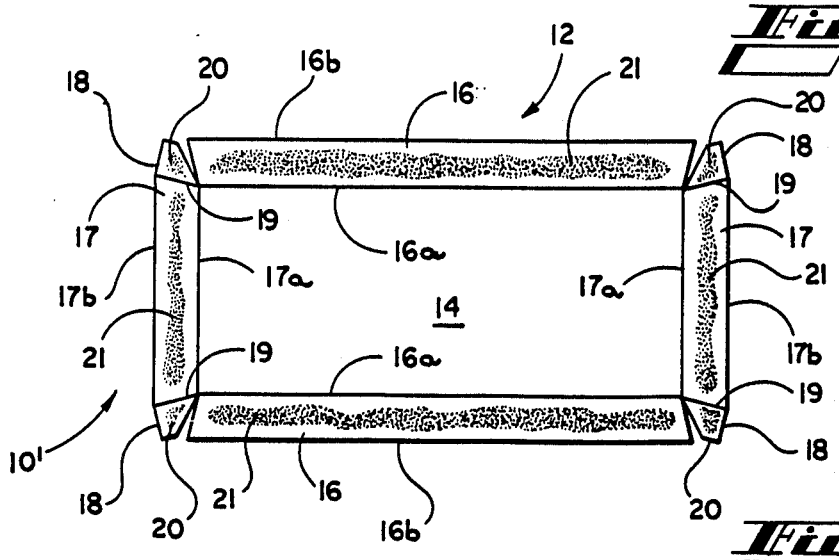
FIG. 2 is a bottom plan view of a blank for forming the base tray of the package of FIG. 1.

Referring now in more detail to the drawing, in which like reference numerals refer to like parts throughout the several views, FIG. 1 shows a composite package 10 embodying the present invention. The package 10 includes a base tray 12 formed from a paperboard blank 10', shown in FIG. 2. Attached to the base tray 12 is a transparent flexible sleeve 25, described below.

The base tray 12 includes a bottom panel 14, which is rectangular in the preferred embodiment shown. However, it should be understood that the base can have other shapes without departing from the invention. A first pair of side panels 16 are foldably connected to the bottom panel 14 along a pair of parallel scores **16*a* extending along opposite edges of the bottom panel. A second pair of side panels 17 are foldably connected along the other opposite edges of the bottom panel 14 at parallel scores 17*a*. The scores 16*a* and 17*a* join to define the outer peripheral edge of the bottom panel 14**.

Each side panel 17 carries a pair of glue flaps 18 at its opposite ends. The four glue flaps 18 are foldably connected to the ends of the side panels 17 along scores 19. It should be noted that all of the side panels 17 and 17 are quadrilaterals increasing in width as they extend away from the bottom panel 14. The scores 19 are thus positioned at an angle with respect to the scores **17*a***.

Figure 3:
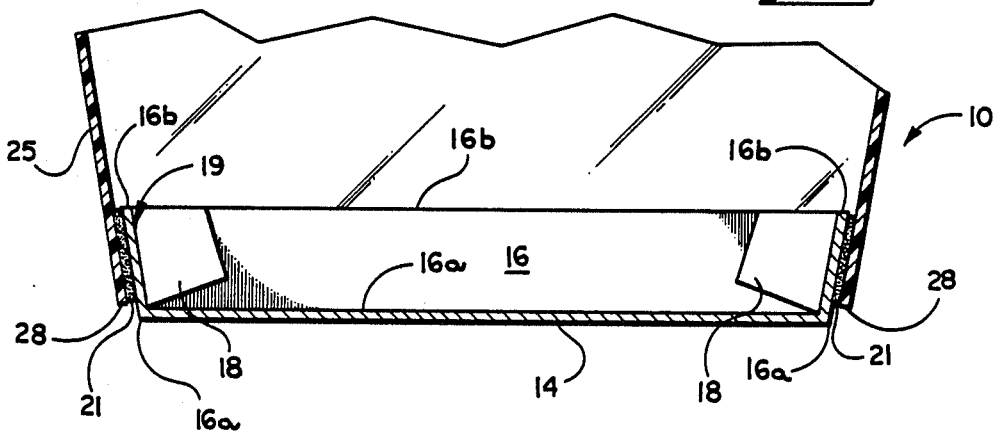
FIG. 3 is a partial side cross sectional view taken along line 3—3 of FIG. 1.
Figure 4:
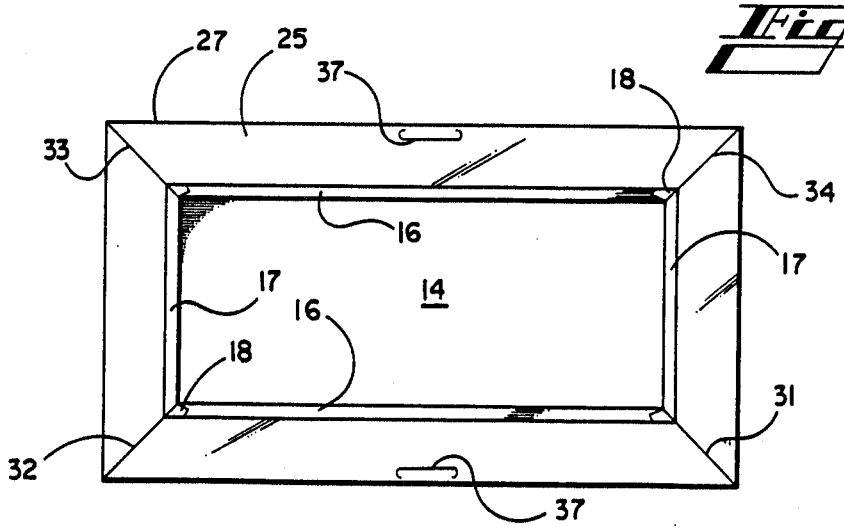
FIG. 4 is a top plan view of the package of FIG. 1.

The glue flaps 18 are coated, on the exterior surface of the blank 10', with a conventional paperboard adhesive 20. The tray 12 is assembled by folding the glue flaps inwardly along the scores 19, and folding the side panels upwardly along the scores **16*a* and 17*a*. The glue panels are engaged against the inner surface of the adjacent side panels 16, as shown in FIGS. 1, 3 and 4. In the assembled configuration of the base, the side panels 16 and 17 form a continuous outwardly tapering side wall, and outer edges 16*b* and 17*b*** of the side panels form a continuous upper edge of the side wall.

If desired or appropriate to the intended use of the package 10, the interior surface of the blank 10' can be coated or laminated with a sealing material (such as wax, plastic film, metal foil or other well known materials) to prevent seepage of moisture or grease through the paperboard base tray.

The sleeve 25 is preferably extruded as a seamless tube of plastic film, and defines a top continuous edge 27 and a bottom continuous edge 28. The tube of plastic film is preferably made slightly conical, either during extrusion or by subsequent stretching. The bottom edge 28 is sized to be longer than the peripheral edge **16*a*,17*a* of the bottom panel 14, but shorter than the upper edge 16*b*,17*b* of the side wall. As best shown in FIG. 4, the bottom edge 28 of the sleeve is positioned against the exterior of the side wall and frictionally engages the side wall. The top edge 27 is longer than the bottom edge 28, and the degree of tapering between the edges of the sleeve matches that of the side panels with respect to the bottom panel. Thus, the base tray 12 can be inserted into the sleeve 25 through the top opening and pressed into frictional engagement with the sleeve adjacent to the bottom edge 28 of the sleeve. The base tray will pass partially into the bottom opening of the sleeve, but will not pass completely through the bottom opening of the sleeve if properly oriented, because the upper edge of the side wall is larger than the bottom edge of the sleeve. Preferably, a conventional adhesive 21 for bonding plastic to paperboard is applied to the exterior surfaces of the side panels 16 and 17** to secure the sleeve to the base tray. Alternately, the plastic sleeve may be heat welded to the paperboard. If the sleeve has suffcient strength and is stretched to engage the side wall, the frictional engagement alone may be sufficient attachment.

The extruded sleeve 25 is preferably creased along lines 31, 32, 33 and 34, extending from the intersections of the side panels 16 and 17 to the top edge 27 of the sleeve. The creases 31–34 help to give the sleeve shape, but are not essential. The sleeve is also provided with a pair of handle slits 37 adjacent to the upper edge 27, to allow a user to grasp the package 10. The strong attachment of the sleeve to the base tray, described above, permits relatively heavy articles to be placed into the package, to rest on the flat bottom panel 14, and to be carried without separation of the sleeve from the bottom panel.

As will be understood from the drawing, the tapering configuration of the package 10 permits large numbers of the packages to be nested together for storage. When needed, the package at the top of the nested stack can easily be removed to be filled with items. The flat, rigid bottom panel 14 provides uninterrupted support for items that must remain upright, such as drink cups and other food items.

The sleeve 25 can be made of a transparent material, for easy determination of the contents. Trademarks and advertising can be displayed on the transparent sleeve, or an opaque colored background can be provided. Cost savings are realized in production because the materials do not greatly overlap. The relatively rigid paperboard is used only where required for a smooth, rigid surface, and the flexible sleeve material is used only to define walls of the package. The unique manner in which the sleeve is affixed to the base tray obviates any need for surrounding the tray with sleeve material.

It should be understood that the sleeve can be made of flexible materials other than plastic, such as paper.

Figure 5:
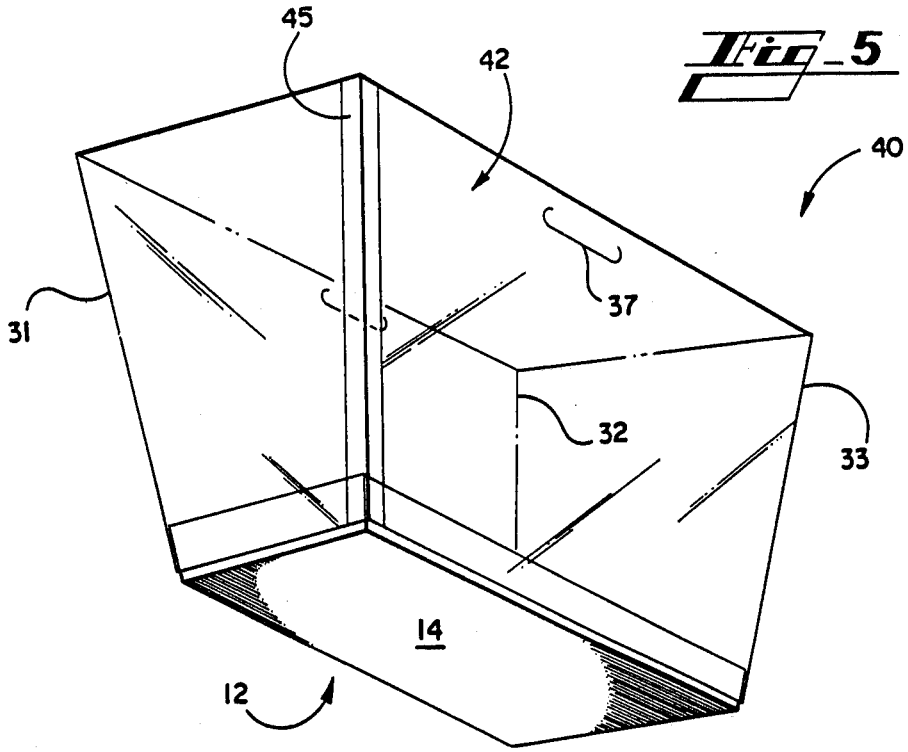
FIG. 5 is a bottom perspective view of a second embodiment of a package according to the present invention.

FIG. 5 shows a second embodiment of a package 40 according to the invention. The package 40 is almost identical to the package 10, except that it includes a sleeve 42 formed of a sheet of film. The sleeve 42 is wrapped around the side wall of the base tray 12 and joined at a vertical seam 45 by welding, bonding, tape, or other suitable means. The sleeve 42 includes three creases 31, 32 and 33 as described above.

Figure 6:
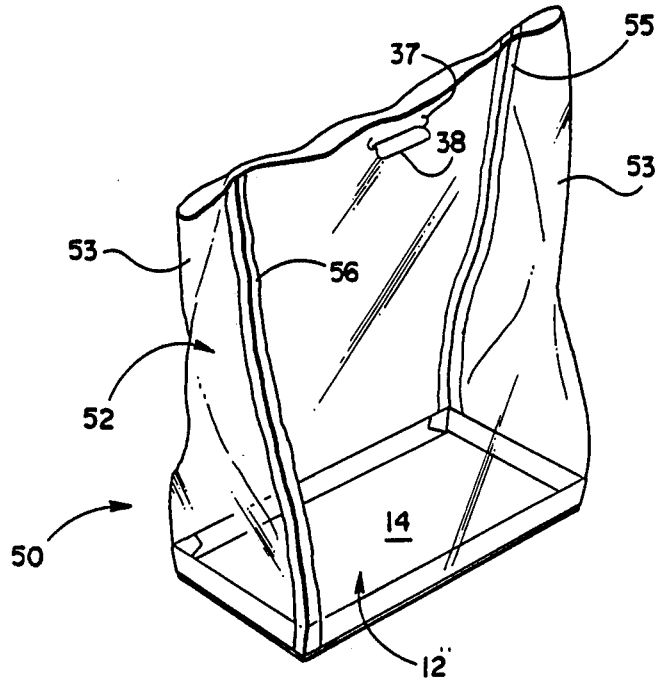
FIG. 6 is a perspective view of a third embodiment of a package according to the present invention, in a closed configuration.

FIG. 6 shows a third embodiment of a package 50 according to the invention. The package 50 includes a sleeve 52 formed of two separate sheets 53 of film applied to the side wall of the base and joined at two vertical seams 55 and 56. The package 50 is shown in a closed configuration, in which opposite sides of the sleeve are brought together. A tab 38, formed by pushing out the sleeve material surrounded by one of the handle slits 37, extends through the other handle slit 37. The tab 38 tends to hold the sleeve in the closed position by locking in the slit 37 in a conventional manner.

Figure 7:
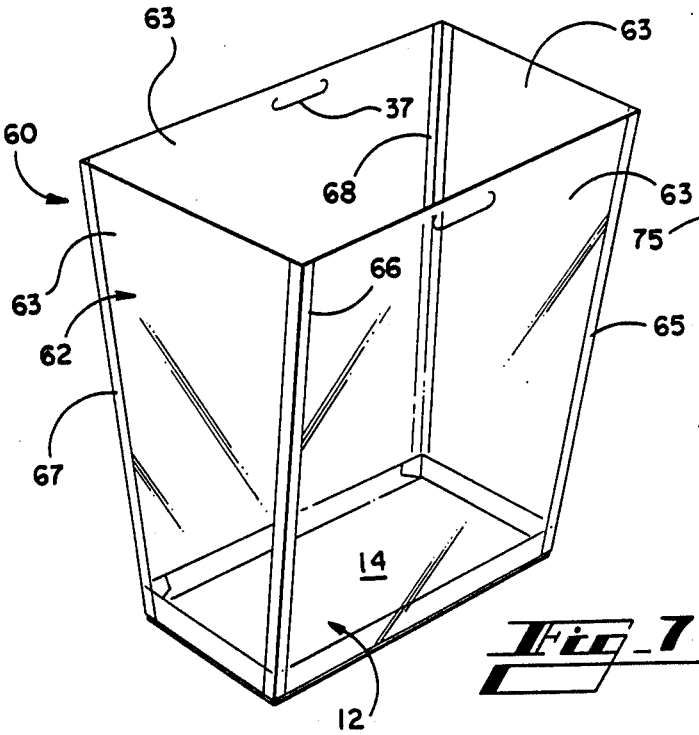
FIG. 7 is a perspective view of a fourth embodiment of a package according to the present invention.

FIG. 7 shows a fourth embodiment of a package 60 according to the invention. The package 60 includes a sleeve 62 formed of four separate sheets 63 of film applied to the side wall of the base tray 12 and joined at four vertical seams 65, 66, 67 and 68.

Figure 8:
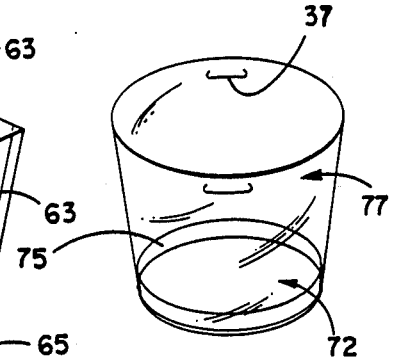
FIG. 8 is a perspective view of a fifth embodiment of a package according to the present invention.

FIG. 8 shows a fifth embodiment of a package 70 according to the invention. The package 70 includes a circular base tray 72 having an annular side wall 75 which tapers outwardly similarly to the side walls of other embodiments. A tapering conical sleeve 77 is attached to the base tray 72 in a manner similar to that described in connection with the embodiment of FIG. 1.

While this invention has been described in detail with particular reference to preferred embodiments thereof, it will be understood that variations and modifications can be effected within the spirit and scope of the invention as described hereinbefore and as defined in the appended claims.

What is claimed is:

1. A package for carrying articles, comprising:

a base tray including a bottom panel defining a peripheral edge and a side wall extending upwardly from the peripheral edge of said bottom panel at an angle greater than 90 degrees from said bottom panel, said side wall defining an upper peripheral edge longer than said peripheral edge of said bottom panel; and a flexible sleeve having a height substantially greater than the height of said base tray sidewall, and having a bottom opening defined by a continuous bottom edge, said bottom edge of said sleeve having a length approximately equal to or greater than the length of said peripheral edge of said bottom panel of said base tray but shorter than the upper peripheral edge of said base tray side wall;

said sleeve being positioned about the exterior of said base tray such that said bottom edge of said sleeve engages said base tray side wall and said articles may be loaded into said sleeves substantially above said upper peripheral edge of said base tray side wall such that said sleeve is engaged by said articles and retains said articles against lateral outward movement.

2. The package of claim 1, further comprising adhesive connecting said sleeve to the exterior of said side wall of said base tray.

3. The package of claim 1, wherein said sleeve tapers outwardly from said bottom edge up, at approximately the same angle as that between said side wall and said bottom panel.

4. The package of claim 3, wherein said sleeve defines a top opening greater in area than the area enclosed by said upper peripheral edge of said side wall.

5. The package of claim 4, further comprising a pair of handle openings in said sleeve adjacent to the top of said sleeve, such that when said package is lifted by said handle openings, said sleeve is urged inwardly toward said articles.

6. The package of claim 1, wherein said side wall includes a plurality of flat side panels connected to one another and extending from said bottom panel.

7. The package of claim 6, wherein said sleeve comprises a plurality of flexible panels each extending upwardly from one of said side panels, said flexible panels being joined to one another along seams extending upwardly from the connections between said side panels.

8. The package of claim 6, wherein said sleeve comprises a sheet of flexible material wrapped around said base tray and joined along a single seam.

9. The package of claim 6, wherein said sleeve comprises two sheets of flexible material wrapped around opposite halves of said base tray and joined along a pair of seams.

10. The package of claim 1, wherein said side wall comprises a frusto-conical member extending from said bottom panel.

11. The package of claim 10, wherein said sleeve comprises an extruded seamless frusto-conical member.

12. The package of claim 1, wherein said sleeve comprises a transparent sheet material.

13. A method of assembling a package of the type used for carrying articles, comprising the steps of:

forming a base tray including a bottom panel defining a peripheral edge at an angle greater than 90 degrees from said bottom panel, and a side wall extending upwardly from the peripheral edge of the bottom panel, said side wall defining an upper peripheral edge longer than said peripheral edge of said bottom panel; and inserting said base tray into a flexbile sleeve having a height substantially greater than the height of said base tray side wall, and having a continuous bottom edge, said bottom edge of said sleeve having a length approximately equal to or greater than the length of said peripheral edge of said bottom panel of said base tray but shorter than the upper peripheral edge of said base tray side wall until said bottom edge frictionally engages said side wall.

* * * * *